United States Patent [19]

San Miguel

[11] 3,989,792

[45] Nov. 2, 1976

[54] METHOD FOR FABRICATING A CONSUMABLE CARTRIDGE CASING

[75] Inventor: Anthony San Miguel, Ridgecrest, Calif.

[73] Assignee: The United States of America as represented by the Secretary of the Navy, Washington, D.C.

[22] Filed: Apr. 1, 1974

[21] Appl. No.: 457,001

[52] U.S. Cl. ..... 264/325; 102/43 P; 102/DIG. 1; 260/37 R; 260/49; 264/3 R; 264/331

[51] Int. Cl.[2] ..... F42B 9/16; F42B 5/30

[58] Field of Search ..... 102/43 P, DIG. 1; 264/331, 323, 325, 322, 320, 319, 3 R, 122; 260/37 R, 49

[56] References Cited

UNITED STATES PATENTS

| | | | |
|---|---|---|---|
| 3,293,056 | 12/1966 | Baker | 102/DIG. 1 |
| 3,745,924 | 7/1973 | Scanlon | 102/43 P |
| 3,770,563 | 11/1973 | Bobinski et al. | 102/43 P |
| 3,794,615 | 2/1974 | Beverly | 264/331 |

*Primary Examiner*—Jeffery R. Thurlow
*Attorney, Agent, or Firm*—R. S. Sciascia; Roy Miller; Lloyd E. K. Pohl

[57] ABSTRACT

The use of polysulfones and powdered oxidizer in the manufacture of cartridges is disclosed.

3 Claims, No Drawings

METHOD FOR FABRICATING A CONSUMABLE CARTRIDGE CASING

BACKGROUND OF THE INVENTION

1. Field of the Invention

This invention relates to cartridges. More particularly, this invention relates to the use of polysulfones in the manufacture of cartridges.

2. Description of the Prior Art

Ordinary brass cartridges have certain drawbacks-especially for military applications. They are expensive and unexpendable. They are heavy. Sometimes they are left lying around after a military action and are later policed up and utilized by the enemy as reloads. These and other drawbacks make the use of reliable resinous cartridges highly desirable.

Resinous cartridges, both consumable, i.e. cartridges made from a resin and an oxidizer which are consumed when they are fired, and non-consumable are known. However, prior art resinous cartridges have certain drawbacks. A drawback of prior art resinous cartridges of both the consumable and the non-consumable varieties is their inability to withstand heat. In the prior art, many of the resins used have been materials which soften or melt in the 200° to 300° F range. Cartridges which soften in this temperature range are unsuitable for use in a gun which has had it chamber heated by several rapid firings. A drawback of prior art resinous cartridges of the consumable variety has been the fact that, when heated toward the point of consumation, the materials used have tended to first liquify and then burn. This causes them to leave residue in gun barrels.

SUMMARY OF THE INVENTION

It has now been found that polysulfones are superior to prior art resinous materials insofar as their use in the manufacture of resinous cartridges-both consumable and non-consumable-is concerned. Non-consumable cartridges having qualities rivaling those of brass and being much lighter and less expensive than brass may be fabricated from polysulfones alone. Consumable cartridges of excellent quality may be fabricated from polysulfones and oxidizers such as ammonium or potassium perchlorate.

DESCRIPTION OF THE PREFERRED EMBODIMENTS

Polysulfones used in the practice of this invention may be any of those described in *Encyclopedia of Polymer Science and Technology*, Volume 11, 1969, John Wiley and Sons, Inc. Bakelite polysulfone is preferred. It is derived from 2,2-bis(4-hydroxyphenyl)propane (bisphenol A) and 4,4-dichlorodiphenyl sulfone, has the structure:

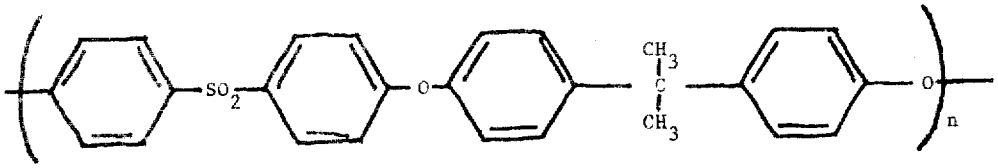

and is manufactured by Union Carbide Corporation. However, other bisphenol A-derived polysulfones and polysulfones prepared by mixing a Friedel-Crafts catalyst with a chlorosulfonated aromatic compound may be used.

Polysulfones may be fabricated into cartridges by utilizing any of the techniques discussed in the *Encyclopedia of Polymer Science and Technology*. That is, polysulfones may be fabricated into cartridges by molding, extruding or thermoforming. Also, as indicated by the *Encyclopedia of Polymer Science and Technology*, polysulfone may be machined.

In tests wherein 5 inch diameter polysulfone artillery cartridges were compared with conventional 5 inch brass cartridges, the physical properties of the polysulfone cartridges compared very favorably with those of the brass cartridges. That is, polysulfone cartridges exhibit adequate tensile strength to withstand stresses and strains placed on them by handling, adequate water resistance to "keep the powder dry" and adequate heat resistance to withstand situations wherein they are placed in gun barrels which have been heated by repeated firings. In addition, polysulfone cartridges are advantageous over brass cartridges in that they are lighter and less expensive.

In a second embodiment of this invention, polysulfones filled with oxidizers such as ammonium perchlorate or potassium perchlorate are utilized to fabricate consumable cartridges. To fabricate a consumable cartridge a mixture containing about 85 to 50 weight percent polysulfone powder and about 15 to 50 weight percent oxidizer powder may be placed in a mold of suitable shape for forming a cartridge and subjected to pressures in the range of from about 100,000 to 150,000 psi. It is permissible to heat the mold (and powder therein) but the temperature should be kept at 450° F or less in order that the autoignition temperature of the oxidizer not be exceeded. Pressing times of from as little as one minute up to as much as one hour may be used. The pressing time depends primarily on the thickness of the cartridge being fabricated and somewhat on the temperature being used.

Cartridges fabricated from polysulfones and either ammonium perchlorate or potassium perchlorate have been found to withstand temperatures up to the autoignition temperature of the oxidizer without appreciable deformation or softening. The ability to withstand such temperatures is more than sufficient to render such cartridges suitable for use in any situation where brass would ordinarily be used. Yet such cartridges have been found to undergo complete pyrolysis (disappear without leaving a residue in the gun barrel) when subjected to temperatures on the order of 4000° F which are produced for a short duration when modern gun powders are exploded.

In manufacturing cartridges from either polysulfone alone or from a combination of polysulfone and oxidizer, it may be desirable to manufacture the cartridge entirely from polysulfone alone or the combination. In the case where the entire cartridge was polysulfone alone, one would have a non-consumable cartridge similar to a brass cartridge except in weight. In the case where the cartridge was a mixture of polysulfone and oxidizer, one would have a consumable cartridge. It may also be desirable to make the cartridge partly polysulfone plus oxidizer and partly polysulfone alone. For example, the cylindrical case of the cartridge could be manufactured to be consumable and the base and rim of the cartridge could be polysulfone alone (non-consumable). In experiments it has been found that the rim of a cartridge is more difficult to consume than the case of a cartridge because the rim is more remote from the exploding powder which is the means for initiating consumation. If the rim and base are non-consumable (polysulfone alone) and the case is consumable (polysulfone plus oxidizer) one denies the enemy use of spent cartridges for reloading purposes while still retaining the rim for purposes such as the extraction of duds.

To further explain, consumable prior art cartridges have ordinarily been rimless because of the difficulty in getting complete consumption of the remote rim. If a cartridge is rimless, the non-existent rim cannot, of course, be used to extract a dud from a gun chamber. If the rim were made non-consumable and the rest of the cartridge was consumable, the rim could be used for extraction of duds while the enemy would still be denied the use of spent cartridges.

What is claimed is:

1. A method for fabricating a consumable cartridge comprising the steps of:

a. mixing from 85 to 50 weight percent polysulfone powder with from 15 to 50 weight percent of a powdered oxidizer;

b. placing the mixed powders in a suitably shaped mold; and c. pressing the mixed powders under a pressure in the range of from 100,000 to 150,000 psi for from 1 minute to 1 hour.

2. A method according to claim 1 wherein said polysulfone powder is derived from the reaction of 2,2-bis(4-hydroxyphenyl) propane and 4,4′-dichlorodiphenyl sulfone.

3. A method according to claim 2 wherein said powdered oxidizer is selected from the group consisting of ammonium perchlorate and potassium perchlorate.

* * * * *